US007416208B2

(12) United States Patent
Deborde et al.

(10) Patent No.: US 7,416,208 B2
(45) Date of Patent: Aug. 26, 2008

(54) GLIDING BOARD

(75) Inventors: Henri-Charles Deborde, Bilieu (FR); Vincent Bregeon, Voiron (FR); Max Mermet, Burcin (FR); Nicolas Bernard, Grenoble (FR)

(73) Assignee: Skis Rossignol S.A., Voiron (FR)

( * ) Notice: Subject to any disclaimer, the term of this patent is extended or adjusted under 35 U.S.C. 154(b) by 136 days.

(21) Appl. No.: 10/685,850

(22) Filed: Oct. 15, 2003

(65) Prior Publication Data

US 2005/0212257 A1 Sep. 29, 2005

(30) Foreign Application Priority Data

Oct. 16, 2002 (FR) ..... 02 12849

(51) Int. Cl.
*A63C 5/052* (2006.01)

(52) U.S. Cl. ..... 280/609

(58) Field of Classification Search ..... 280/609, 280/610, 14.21
See application file for complete search history.

(56) References Cited

U.S. PATENT DOCUMENTS

| | | | | | |
|---|---|---|---|---|---|
| 3,332,697 | A | * | 7/1967 | Hagen | 280/14.21 |
| 3,782,745 | A | * | 1/1974 | Stoveken | 280/18 |
| 4,085,947 | A | * | 4/1978 | Sarver | 280/607 |
| 5,249,819 | A | | 10/1993 | Mayr | |
| 5,462,304 | A | * | 10/1995 | Nyman | 280/609 |
| 5,788,259 | A | * | 8/1998 | Emig | 280/609 |
| RE36,453 | E | * | 12/1999 | Abondance et al. | 280/609 |
| 6,183,000 | B1 | * | 2/2001 | Piatti | 280/610 |
| 6,290,249 | B1 | * | 9/2001 | Wolf | 280/609 |
| 6,481,741 | B1 | | 11/2002 | Porte | |
| 2001/0022439 | A1 | * | 9/2001 | Andrus et al. | 280/610 |

FOREIGN PATENT DOCUMENTS

| | | | | |
|---|---|---|---|---|
| FR | 2598929 | * | 11/1987 | 280/609 |
| FR | 2 720 288 A | * | 12/1995 | |
| FR | 2 804 335 | | 8/2001 | |
| WO | 90/03205 | | 4/1990 | |

* cited by examiner

*Primary Examiner*—Frank B Vanaman
(74) *Attorney, Agent, or Firm*—Burr & Brown

(57) ABSTRACT

A gliding board, including a gliding surface that terminates in at least one raised end, the end including a peripheral zone and a central zone. The peripheral zone extends from the side of the board toward the central zone the end. This peripheral zone has a thickness, which is less than that of the central zone of the end. The peripheral zone connects to the central zone by a discontinuity that forms an inflexion. The width of the peripheral zone, measured perpendicularly to the side of the board, increases from the beginning of the end to the highest point of the end.

6 Claims, 1 Drawing Sheet

-1-

GLIDING BOARD

This application claims the benefit of French Application 02.12849, filed Oct. 16, 2002, the entirety of which is incorporated herein by reference.

TECHNICAL FIELD

The invention relates to the field of snow gliding boards, and concerns a board structure such as an alpine ski, a snowboard or even a crosscountry ski.

It relates more particularly to a tip or heel structure that limits the risks of cracking, especially due to impacts when cold.

PRIOR ART

In general, the tip of an alpine, backcountry or crosscountry ski, or even a snowboard, is raised in order to allow the ski to pass over the obstacles on the run. When the ski encounters an obstacle, the tip hence tends to deform and is therefore subjected to mechanical stresses which may be large. Likewise, when the ski is flat, the tip forms an elevated zone that can experience numerous impacts, or even deform, for example when standing in line for ski lifts. The mechanical stresses when the tip is pressed down by a vertical force are then very large.

It is moreover known that, in general, skis have a structure including a stack of various superimposed layers. In the tip, these various superimposed layers come together or terminate to form a complex structure. It is at the tip that the side-edges terminate, as generally do the core of the ski and the upper and lower reinforcements lying on either side of the core. This results in discontinuities of the structure of the tip in these various regions, which weakens the layer forming the upper face of the ski, also referred to as the "protective upper layer", when the tip experiences strong mechanical stresses and, for example, when the tip is pressed down or is deformed when skiing.

Cracking of this protective upper layer is then observed, and all the more so when the outside temperature is low and the material of the protective upper layer therefore becomes rigid. These phenomena are encountered when the tip collides with an obstacle or another ski, or alternatively when the ski strikes the snow, causing a whiplash movement of the tip. It has been noted that this cracking generally occurs close to the end of the metal edge adjacent to the gliding surface. This is because the interface between the metal edge and the rest of the structure of the front of the tip constitutes a point of weakness where the mechanical stresses are concentrated, therefore giving rise to significant risks of the protective upper layer cracking. It has also been observed that these cracks originate on the sides of the tip then propagate transversely to the entire width of the protective upper layer.

One problem which the invention therefore proposes to solve is that of the appearance of cracks on the protective upper layer, in the tip region of the ski. The same problem is obviously encountered with other gliding boards, such as crosscountry skis, backcountry skis or alternatively a snowboard. This problem has also been observed, albeit to a lesser extent, on ski rear ends which are also slightly raised.

This problem is also observed on snowboards, and especially those described in U.S. Pat. No. 6,481,741. These boards are designed with a view to reducing the resistance to flexion of the ends, which are slightly raised. To this end, the core of the board is of constant thickness but it has a variable width that decreases in the direction of the ends of the board.

Level with the beginning of the tip, the structure of the board is therefore weakened because it is relatively thin over a fairly large width.

DESCRIPTION OF THE INVENTION

The invention, therefore, relates to a gliding board including a gliding surface that terminates in at least one raised end, namely at the front of the tip and/or the rear of the heel.

The end of this board includes a peripheral zone and a central zone, the peripheral zone extending from the side of the board toward the central zone of the end. This peripheral zone has a thickness which is less than that of the central zone of the end, and is connected to the latter by a discontinuity that forms an inflexion.

According to the invention, the width of the characteristic peripheral zone, measured perpendicularly to the side of the board, increases from the beginning of the raised end as far as the highest point of this end.

In other words, the thickness of the tip is greatly reduced close to the side of the board, which means that the protective upper layer of the board experiences reduced stresses when the tip is deformed, so as to greatly reduce the risks of the protective upper layer cracking. The overall rigidity of the tip is maintained by its central part which has a sufficient thickness, corresponding substantially to that of the rest of the front of the board, level with the beginning of the tip. The discontinuity separating the central zone of the tip from the thinner peripheral zone moves progressively away from the side of the board to form an arc, whose shape resembles that of the side of the tip but which is offset inside the latter. The technical effect of reducing the cracking risk is then supplemented by an esthetic effect for the tip configured in this way.

In practice, the upper face of the characteristic peripheral zone may be either substantially parallel to the lower face of the board or, alternatively, slightly inclined downward and toward the side of the board.

In practice, the characteristic peripheral zone is preferably symmetrical with respect to the longitudinal mid-plane of the board.

In practice, it has been observed that the risks of the protective upper layer cracking are greatly reduced when the width of the peripheral zone, measured level with the interruption of the metal edge, is more than 5 mm in the case of an alpine ski, or 10 mm in the case of a snowboard, which is wider.

BRIEF DESCRIPTION OF THE FIGURES

The way in which the invention is embodied, and the advantages that result therefrom, will become readily apparent from the description of the following embodiments, supported by the appended figures in which.

EMBODIMENTS OF THE INVENTION

As already mentioned, the invention relates to a gliding board, which is an alpine ski in the example illustrated in the figures. The invention may, however, be applied in the same way to any other type of ski, such as backcountry skis, short skis or skating skis, or alternatively crosscountry skis. In the same way, a snowboard may also be constructed according to the principles of the invention.

Figure 1:
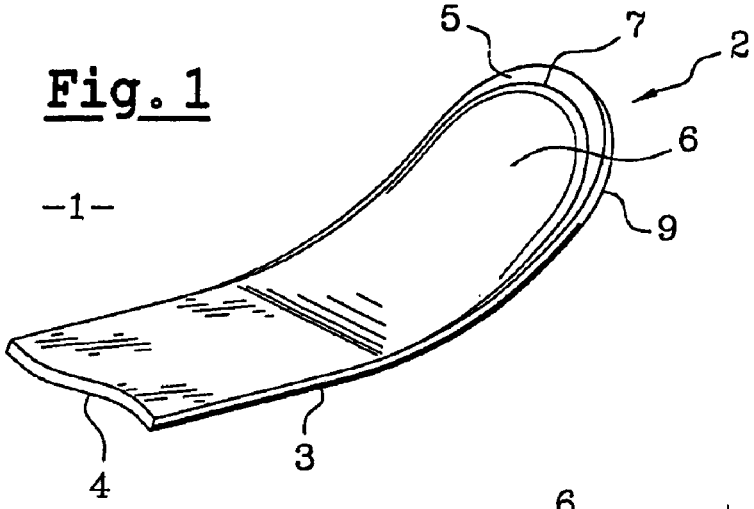
FIG. 1 is a summary perspective view of the tip of a ski according to the invention.
Figure 2:
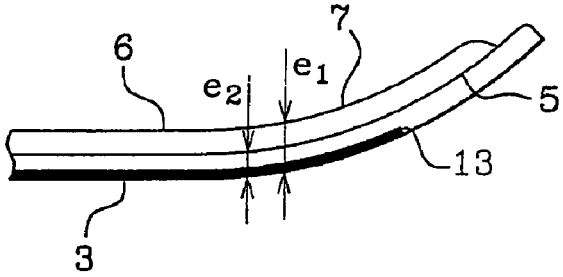
FIG. 2 is a side view of the ski in FIG. 1.

Hence, as illustrated in FIG. 1, a ski (1) includes a raised front end (2) forming the tip. In general, the ski (1) has edges (3) adjacent to the gliding surface (4) on its lower corners. According to the invention, the tip (2) has a peripheral zone (5), which is adjacent to a central zone (6) and is separated from the latter by a discontinuity (7).

This discontinuity (7) is such that the thickness (e1) of the tip (2) in the central zone (6) is much greater than the thickness (e2) of the tip level with the peripheral zone (5). The term "discontinuity" is intended to mean that there is a substantial difference in thickness, of the order of 2 mm.

The thickness (e2) of the peripheral zone (5) may either be substantially constant over the entire periphery of the tip (2), or it may have certain variations. This thickness (e2) may also be constant at a given longitudinal level of the board, so that the upper face of the peripheral zone (5) is then parallel to the gliding surface (4) of the board.

In other variants, the thickness (e2) of the peripheral zone (5) may be slightly variable; for example, it may decrease when approaching the side (9) of the board. In this case, the upper face of the peripheral zone is then slightly inclined downward and outward. Many variants may be conceived by combining these various provisions, without departing from the scope of the invention.

Figure 3:
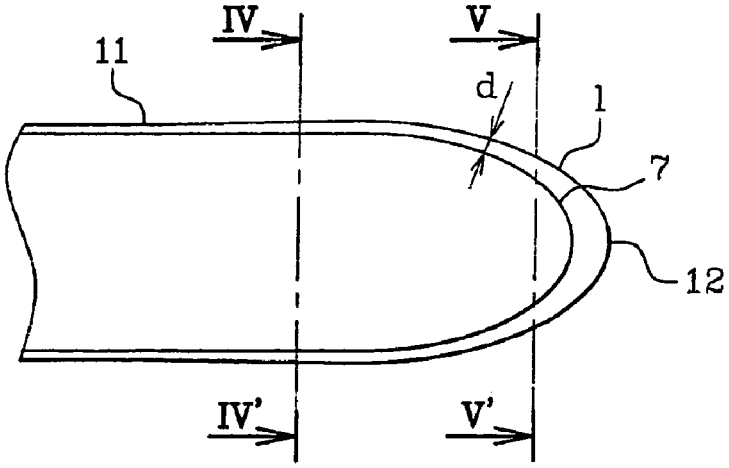
FIG. 3 is a top view of the front end of the ski in FIG. 1.

As illustrated in FIG. 3, the width (d) of the peripheral zone (5) may be variable over the perimeter of the tip (2). For instance, this width (d), measured perpendicularly to the side (9) of the tip, between the latter and the discontinuity (7), begins substantially from a value of zero level with the beginning of the peripheral zone, to reach a maximum value at the apex (12) of the tip. The width (d) measured level with the end (13) of the side edge (3) is typically more than 5 mm, in order to obtain sufficient limitation of the risks that the protective upper layer (15) illustrated in FIG. 4 may crack.

Figure 4:
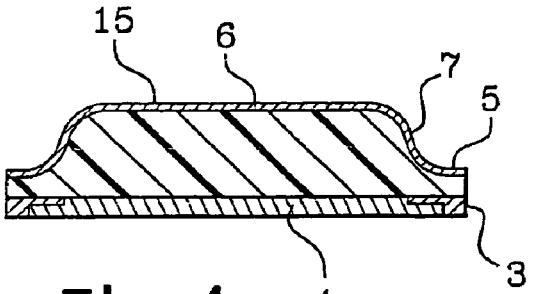
FIGS. 4 and 5 are views in section, respectively on the planes IV-IV' and V-V' in FIG. 3.
Figure 5:
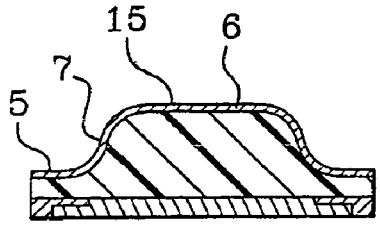

Hence, as illustrated in FIGS. 4 and 5, the protective upper layer (15) is closer to the gliding surface (4) of the board level with the peripheral zone (5) than it is level with the central zone (6) of the tip. The internal structure of the board, between the protective upper layer (15) and the gliding surface (4), has intentionally been omitted from FIGS. 4 and 5 since it can adopt many architectures, depending on whether the core is made either based on preshaped pieces or, alternatively, is made directly by in situ injection of components that expand during the molding. The characteristic discontinuity may result from a discontinuity formed in the core. Many metal, fiber or other reinforcements may be used without departing from the scope of the invention.

Of course, the design of the tip illustrated in the figures may be applied to the rear zone of a ski in order to form the heel elevation, or alternatively to other types of boards, especially to snowboards, with the dimensions being adapted to the size the board.

It can be seen from the explanation above that the design of the tip or, more generally, of the end of the board according to the invention, makes it possible to limit very greatly the risks of cracking of the protective upper layer and, more generally, of the structure of the board when the tip experiences significant deformations, especially in the event of impacts.

The invention claimed is:

1. A gliding board, comprising:

a gliding surface that terminates in at least one raised end, said end being an elevated zone when said gliding board is flat such that said end extends a distance from a low point where said gliding surface begins to elevate and extends to a highest point, of said elevated zone, said end having a peripheral zone and a central zone, the peripheral zone extending from sides of said end toward the central zone of said end, the peripheral zone having a thickness which is less than a thickness of the central zone of said end and being connected to the central zone by a discontinuity that forms an inflexion surface continuously extending throughout a length of said discontinuity in said end to form a smooth arc between said sides of said end, an upper face of the central zone extending to an intermediate point along a center longitudinal axis of said end that is positioned between the low point and the highest point and is closer to the highest point than the low point; and a pair of metal edges adjacent said gliding surface, each of said edges terminating at a point within said end, a width of said peripheral zone being at least 5 mm at a location adjacent said termination point, wherein (i) an upper face of the peripheral zone is substantially parallel to the gliding surface, (ii) a width of the peripheral zone, measured from a nearest point along the side of said end, increases from a value of zero level with a beginning of said peripheral zone to a maximum value at said highest point of said end, (iii) a vertex of said arc extends to a highest point of said inflexion surface along said end at a point substantially along the center longitudinal axis of said end, (iv) said upper face of the central zone is substantially parallel to the gliding surface within said end, and (v) a continuous protective cover extends along said central zone, said discontinuity, and said peripheral zone throughout said end.

2. The gliding board as claimed in claim 1, wherein the peripheral zone is symmetrical with respect to a longitudinal mid-plane of the board.

3. The gliding board as claimed in claim 1, wherein said end forms a front tip of the board.

4. A gliding board, comprising:

a gliding surface that terminates in at least one raised end, said end being an elevated zone when said gliding board is flat such that said end extends a distance from a low point where said gliding surface begins to elevate and extends to a highest point of said elevated zone said end having a peripheral zone and a central zone, the peripheral zone extending from sides of said end toward the central zone of said end, the peripheral zone having a thickness which is less than a thickness of the central zone of said end and being connected to the central zone by a discontinuity that forms an inflexion surface continuously extending throughout a length of said discontinuity in said end to form a smooth are between said sides of said end, an upper face of said central zone extending to an intermediate point along a center longitudinal axis of said end that is positioned between the low point and the highest point and is closer to the highest point than the low point; and a pain of metal edges adjacent said gliding surface, each of said edges terminating at a termination point within said end, a width of said peripheral zone being at least 5 mm at a location adjacent said termination point.

wherein (i) an upper face of the peripheral zone is substantially parallel to the gliding surface, (ii) a width of the peripheral zone, measured from a nearest point along the side of said end, increases from a value of zero level with a beginning of said peripheral at zone said low point of said end to a maximum value at said highest point of said end, (iii) a vertex of said are extends to a highest point of said inflexion surface along said end at a point substantially along the center longitudinal axis of said end, (iv)

said thickness of the central zone is substantially thicker than said thickness of the peripheral zone throughout said length of said discontinuity, (v) said upper face of the central zone is substantially parallel to the gliding surface within said end, and (vi) continuous protective cover extends along said central zone, said discontinuity, peripheral zone throughout said end.

5. The gliding board as claimed in claim 4, wherein the peripheral zone is symmetrical with respect to a longitudinal mid-plane of the board.

6. The gliding board as claimed in claim 4, wherein said end forms a front tip of the board.

* * * * *